US009453620B2

(12) United States Patent
Green et al.

(10) Patent No.: US 9,453,620 B2
(45) Date of Patent: Sep. 27, 2016

(54) STRIP FIXTURE RETROFIT SYSTEMS AND METHODS

(71) Applicant: Orion Energy Systems, Inc., Manitowoc, WI (US)

(72) Inventors: Scott A. Green, Ponte Vedra Beach, FL (US); Scott W. Lowden, Orange Park, FL (US); George S. Wilson, Middleburg, FL (US); John Scribante, Manitowoc, WI (US)

(73) Assignee: Orion Energy Systems, Inc., Manitowoc, WI (US)

( * ) Notice: Subject to any disclaimer, the term of this patent is extended or adjusted under 35 U.S.C. 154(b) by 0 days.

(21) Appl. No.: 14/879,036

(22) Filed: Oct. 8, 2015

(65) Prior Publication Data

US 2016/0102814 A1 Apr. 14, 2016

Related U.S. Application Data

(60) Provisional application No. 62/061,550, filed on Oct. 8, 2014.

(51) Int. Cl.

| | |
|---|---|
| ***F21K 99/00*** | (2016.01) |
| ***F21S 4/00*** | (2016.01) |
| ***F21V 23/00*** | (2015.01) |
| *F21Y 101/02* | (2006.01) |
| *F21Y 103/00* | (2016.01) |

(52) U.S. Cl.

CPC ..... *F21K 9/175* (2013.01); *F21S 4/008* (2013.01); *F21V 23/007* (2013.01); *F21Y 2101/02* (2013.01); *F21Y 2103/003* (2013.01)

(58) Field of Classification Search

CPC ..... F21K 9/17; F21K 9/175; F21K 9/30; F21S 4/008; F21Y 2103/00; F21Y 2103/003; F21V 19/0045; F21V 21/34

See application file for complete search history.

(56) References Cited

U.S. PATENT DOCUMENTS

| | | | | |
|---|---|---|---|---|
| 4,497,014 | A * | 1/1985 | Woloski | F21V 21/04 362/150 |
| 4,941,071 | A * | 7/1990 | Knauf | F21S 8/00 362/133 |
| 5,997,158 | A * | 12/1999 | Fischer | F21S 8/04 362/364 |
| 6,276,818 | B1 * | 8/2001 | Wang | E05B 17/0025 292/5 |
| 8,272,763 | B1 * | 9/2012 | Chinnam | F21V 29/004 362/147 |
| 8,454,194 | B2 * | 6/2013 | Liu | F21S 2/005 362/218 |
| 8,643,043 | B2 * | 2/2014 | Shimizu | F21S 4/008 257/88 |
| 2014/0268748 | A1 * | 9/2014 | Lay | F21V 15/01 362/235 |

* cited by examiner

*Primary Examiner* — Alan Cariaso
(74) *Attorney, Agent, or Firm* — Foley & Lardner LLP

(57) ABSTRACT

A retrofit light fixture for retrofitting an existing strip-style light fixture includes a housing, a light emitting diode, a driver, and a bracket. The housing includes a top portion, a side portion, and an end cap, and the housing defines an interior space. At least one of the top portion and the side portion define an elongated opening. The bracket includes a locking flange configured to selectively engage with a portion of a housing of the existing strip-style light fixture. The bracket is slidably coupled to the housing with a fastener that extends through the elongated opening. The bracket is selectively repositionable between a disengaged orientation and an engaged orientation, and the bracket is configured to interface with a portion of the existing strip-style light fixture and thereby secure the retrofit light fixture in place when selectively repositioned into the disengaged orientation.

15 Claims, 13 Drawing Sheets

STRIP FIXTURE RETROFIT SYSTEMS AND METHODS

CROSS-REFERENCE TO RELATED APPLICATIONS

This application claims the benefit of U.S. Provisional Patent Application No. 62/061,550, filed Oct. 8, 2014, which is incorporated herein by reference in its entirety.

BACKGROUND

The invention relates generally to a system and method for retrofitting an existing strip-style light fixture. Existing strip light fixtures can be retrofitted to include a more efficient light source, replace components of a damaged strip-style light fixture, and/or otherwise upgrade or replace an existing strip light fixture. Strip light fixtures commonly include a fluorescent or other type of lamp. In some cases, a strip fixture includes two fluorescent lamps suspended by lamp holders beneath a housing. The lamp holders may exit the housing through an opening in a flange of the housing. The housing includes a ballast and/or supporting electronics (e.g., power supply, connection to a power source, etc.). The housing can include a plate that is repositionable to facilitate accessing the components within the housing. It is challenging and difficult to develop a light fixture which retrofits an existing strip fixture quickly and easily.

SUMMARY

One embodiment relates to a retrofit light fixture for retrofitting an existing strip-style light fixture that includes a housing, a light emitting diode, a driver, and a bracket. The housing includes a top portion, a side portion, and an end cap, and the housing defines an interior space. At least one of the top portion and the side portion define an elongated opening. The light emitting diode is coupled to the top portion of the housing. The driver is disposed within the interior space of the housing and is configured to interface with the light emitting diode. The bracket includes a locking flange configured to selectively engage with a portion of a housing of the existing strip-style light fixture. The bracket is slidably coupled to the housing with a fastener that extends through the elongated opening. The bracket is selectively repositionable between a disengaged orientation and an engaged orientation, and the bracket is configured to interface with a portion of the existing strip-style light fixture and thereby secure the retrofit light fixture in place when selectively repositioned into the engaged orientation.

Another embodiment relates to a retrofit light fixture for retrofitting an existing strip-style light fixture that includes a housing, a light source coupled to the housing, and a bracket slidably coupled to the housing and configured to selectively engage with a portion of the existing strip-style light fixture.

Another embodiment relates to a method for retrofitting an existing strip-style light fixture with a light fixture that includes repositioning at least one component of the existing strip-style light fixture, placing the light fixture around the existing strip-style light fixture, a housing of the light fixture at least partially surrounding a housing of the existing strip-style light fixture, and actuating a sliding bracket of the light fixture into a locked position. A portion of the sliding bracket engages with a portion of the housing of the existing strip-style light fixture to secure the light fixture to the existing strip-style light fixture.

The invention is capable of other embodiments and of being carried out in various ways. Alternative exemplary embodiments relate to other features and combinations of features as may be recited herein.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
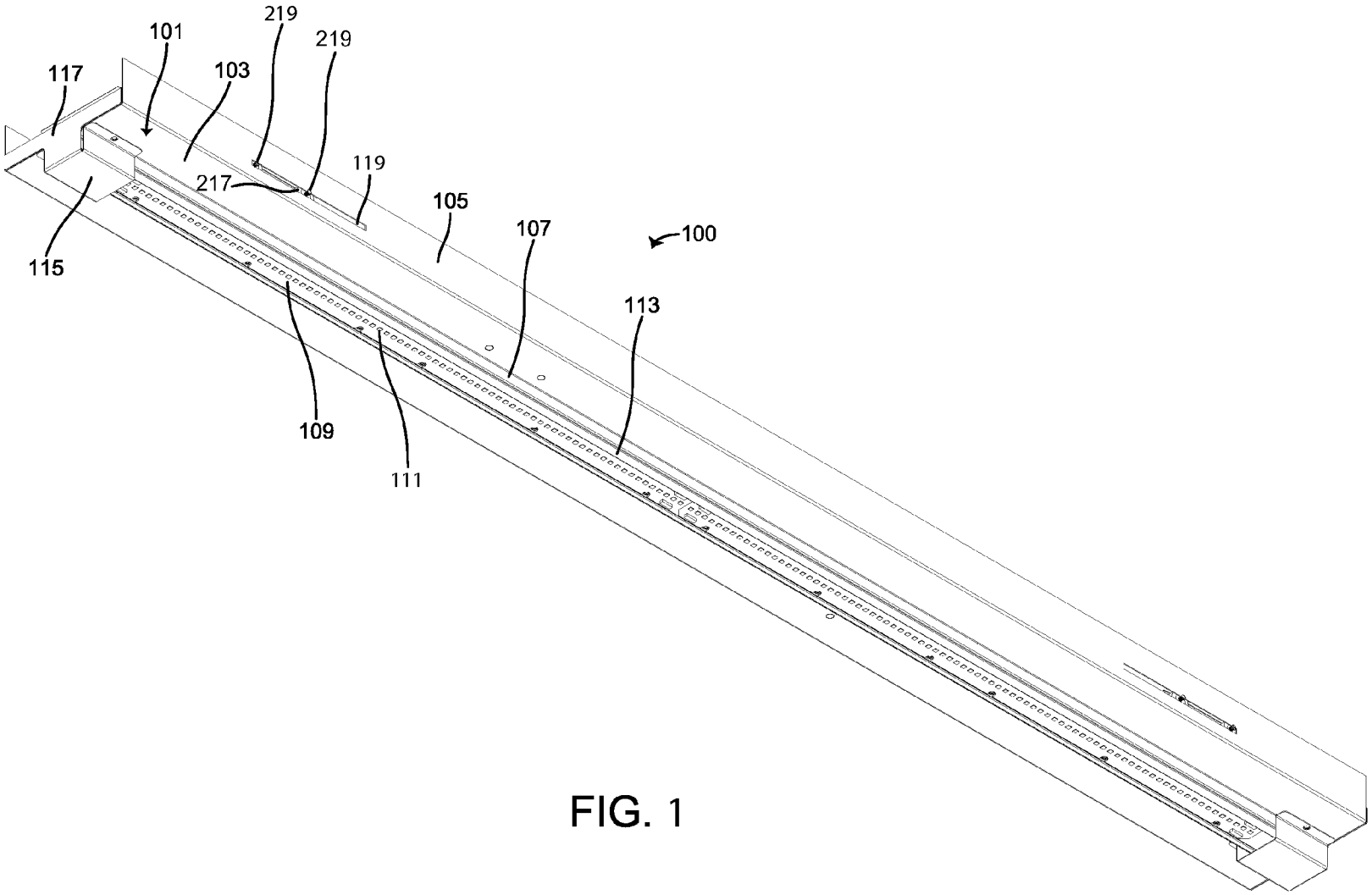
FIG. 1 is an illustration of a strip fixture for retrofitting an existing light fixture, according to one embodiment.

In the following detailed description, reference is made to the accompanying drawings. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

According to the various embodiment shown in FIGS. 1-14, a light fixture 100 includes a light source and one or more elements particularly configured to facilitate retrofit installation. As shown in FIG. 1, light fixture 100 may be used to retrofit an existing strip fixture 301. Advantageously, the light fixture 100 includes features that make retrofitting the existing strip fixture 301 quick and easy. In one embodiment, light fixture 100 includes brackets 201 that engage a portion of the housing 303 of the existing strip fixture 301. Brackets 201 may slide relative to housing 303 and/or other portions of light fixture 100. As part of a retrofit installation process, an installer may remove the lamps, lamp holders 307, access plate 305, ballast 313, and/or other components of the existing strip fixture 301. The installer may thereafter wire the light fixture 100 to a power supply or power source coupled to or powering the existing strip fixture 301. The installer may then place the light fixture 100 over the existing strip fixture 301 such that the housing 101 of the light fixture 100 extends at least partially over and/or around the housing 303 of the existing strip fixture. The installer may then actuate brackets 201, engaging a portion of the housing 303 of the existing strip fixture 301, to secure light fixture 100 to the existing strip fixture 301. Brackets 201 may thereby facilitate using light fixture 100 in retrofitting existing strip fixture 301. Advantageously, light fixture 100 may include one or more light emitting diodes (LEDs) 111 such that fluorescent lamps or other less efficient lamps of existing strip fixture 301 are replaced by more efficient LEDs 111 of light fixture 100 as a result of the retrofit. In some embodiments, light fixture 100 also includes motion sensors, control circuitry, transceivers, sensors, and/or other electronic components. Retrofitting an existing strip fixture 301 with light fixture 100 may therefore increase the control capability of the resulting retrofit fixture (e.g., relative to that of the existing strip fixture 301, etc.).

Referring now to FIG. 1, a bottom view of light fixture 100 is illustrated, according to one embodiment. Light fixture 100 includes a housing 101. Housing 101 is configured to fit over and/or around at least a portion of an existing strip fixture 301. Advantageously, housing 101 may obscure the housing and/or other components of an existing strip fixture 301 when light fixture 100 is used to retrofit the existing strip fixture 301. Damage, deterioration due to age, and/or other imperfections of existing strip fixture 301 are hidden from view completely or partially by housing 101 when the existing strip fixture 301 is retrofit using light fixture 100. By hiding existing strip fixture 301, light fixture 100 may provide a more aesthetically pleasing appearance for the resulting fixture. As shown in FIG. 1, housing 101 includes a top portion 103, side portions 105, and end caps 117. In one embodiment, housing 101 is formed from a single piece of material (e.g., a metal sheet) using techniques such as bending. End caps 117 may be attached to housing 101 using fasteners. In alternative embodiments, housing 101 including top portion 103, side portions 105, and/or end caps 117 is formed using stamping, forging, molding, welding, and/or one or more other manufacturing techniques. Housing 101 may be or include metal (e.g., aluminum, aluminum alloys, steel, etc.), plastics, polymers, natural materials (e.g., wood), and/or other materials. Housing 101 may have an adjustable and/or various widths, heights, lengths, and/or other dimensions in various embodiments. Advantageously, such adjustability and/or variability may allow housing 101 to fit over existing strip fixtures 301 of various dimensions. In one embodiment, housing 101 has a width such that housing 101 fits over existing strip fixture 301 of multiple common widths (e.g., a first common width and a second, narrower common width, etc.). Advantageously, the width of housing 101 may facilitate the use of light fixture 100 having a single width in retrofitting existing strip fixtures 301 of multiple (e.g., two, etc.) widths, increasing the compatibility of light fixture 100 with existing strip fixtures 301.

In some embodiments, light fixture 100 includes one or more lens retainers 115. End caps 117 and lens retainers 115 may be fastened to top portion 103 of housing 101 such that lens 113 is held in place by lens retainers 115. Lens 113 may be any lens for use in a light fixture and may affect the properties of light produced by light fixture 100. For example, lens 113 may filter the light output, direct the light output, create a specific distribution pattern of the light output, reduce the intensity of the light output, and/or otherwise alter light produced by the one or more light sources of light fixture 100. In alternative embodiments, light fixture 100 does not include lens 113 and/or lens retainers 115. In some cases, LED strips 109 and/or individual LEDs 111 have individual lenses. Light fixture 100 may include one, two, or other numbers of LED strips 109. The number of LED strips 109 provided with light fixture 100 may be related to the length and/or width of a specific embodiment of light fixture 100. In one embodiment, LED strips 109 are positioned end to end. In alternative embodiments, LED strips 109 are positioned side by side and/or end to end. In still further alternative embodiments, light fixture 100 includes a light source other than LEDs 111. For example, light fixture 100 may include organic light emitting diodes, incandescent lamps, fluorescent lamps, and/or other types of light sources.

In some embodiments, lens 113 and/or LED strips 109 are secured to housing 101 via mounting plate 107. Mounting plate 107 may form a channel that receives lens 113 and/or LED strips 109. Mounting plate 107 is coupled to housing 101 using fasteners, according to one embodiment. Mounting plate 107 may further include one or more channels configured to facilitate wiring LED strips 109 and/or other light sources to a power supply, driver 401, control circuit, motion sensors, and/or another component. Such components may be disposed within housing 101.

Figure 2:
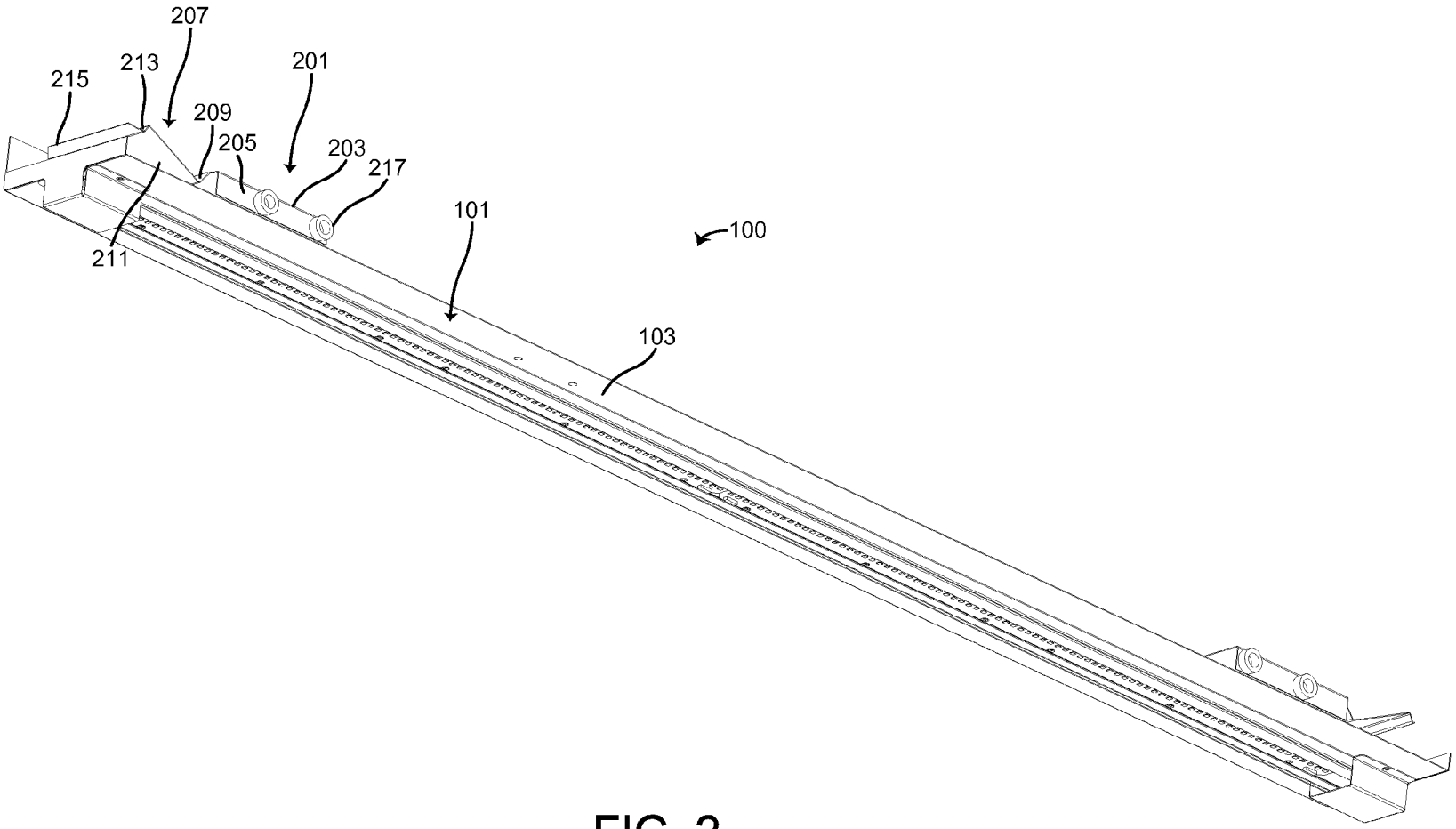
FIG. 2 is a sectional view of a strip fixture for retrofitting an existing light fixture, according to one embodiment.

As shown in FIG. 2, fixture 100 includes two brackets 201. As explained in greater detail with reference to FIGS. 3A-3D, brackets 201 engage with housing 303 of an existing strip fixture 301 to secure light fixture 100 to the existing strip fixture 301. By way of example, brackets 201 may slide into engagement with housing 303.

Referring again to FIG. 1, brackets 201 are slidably coupled to housing 101, facilitating relative movement between brackets 201 and housing 101. In one embodiment, brackets 201 are coupled to side 105 of housing 101. By way of example, a fastener 219 may extend through an elongated opening, shown as slot 119, in side 105 of housing 101 and engage bracket 201 thereby slidably coupling bracket 201 to side 105 of housing 101. The fastener may be any type of mechanical fastener suitable for coupling bracket 201 to housing 101 through slot 119. Fastener 219 movably couples sliding bracket 201 to housing 101, according to an exemplary embodiment, such that bracket 201 is capable of sliding relative to housing 101. For example, fastener 219 may be a screw, shaft and cotter pin, screw, and/or other fastener. In one embodiment, fastener 219 is a shaft or peg and bracket 201 is secured horizontally to spacers 217 and/or housing 101. In further embodiments, at least one fastener 219 is a set screw positioned such that, when tightened, it prevents bracket 201 from sliding. In one embodiment, the fastener 219 is coupled to bracket 201. Fastener 219 may include a first portion that is larger than slot 119 (i.e., cannot pass through slot 119) and a second, connecting portion coupling the first portion to bracket 201. Such an arrangement allows bracket 201 to move relative to housing 101 as fastener 219 supports bracket 201 vertically and moves back and forth through slot 119. As fasteners 219 are unable to pass entirely through slot 119 and bracket 201 is unable to pass through slot 119, bracket 201 remains in place within light fixture 100 (e.g., between sides 105, etc.). Bracket 201 is coupled to housing 101 by a second slot 119 and set of fasteners 219 on the other side of light fixture 100 in some embodiments. In other embodiments, a single slot 119 and set of fasteners 219 couples bracket 201 to housing 101. The use of two fasteners 219 through each slot 119 may prevent bracket 201 from rotating relative to housing 101 (e.g., pitching, etc.). Advantageously, this may prevent bracket 201 from becoming disengaged with a portion of the housing 303 of an existing strip fixture 301. In other embodiments, housing 101 defines slot 119 in a bottom-facing surface thereof. By way of example, top portion 103 may define slots 119, and fasteners 219 may extend through such slots 119 to slidably couple brackets 201 to housing 101.

In some embodiments, one or more of fasteners 219 are or function as set screws. Fasteners 219 may be tightened (e.g., by hand, with a tool such as a wrench or screw driver, etc.). Tightening fasteners 219 to housing 101 may prevent bracket 201 from moving (e.g., longitudinally, laterally, etc.) relative to housing 101 and/or an existing strip fixture 301. Advantageously, preventing such movement may reduce the risk of brackets 201 inadvertently becoming disengaged from an existing strip fixture 301. In further embodiments, fasteners 219 may be, include, or additionally fasten to housing 101 a handle portion. The handle portion may be used by an installer to actuate (e.g., slide into locking position) the bracket 201.

In some embodiments, light fixture 100 includes spacers 217. As discussed in greater detail with reference to FIG. 2, spacers 217 may be disposed within housing 101 and extend between bracket 201 and housing 101. Spacers 217 may align and/or center bracket 201 within housing 101.

Referring now to FIG. 2, a sectional view of light fixture 100 is illustrated, according to one embodiment. Bracket 201 within housing 101 is illustrated as viewed through side portion 105 of housing 101. In some embodiments, bracket 201 is secured to housing 101 using fasteners 219 and slots 119. Bracket 201 may be suspended within housing 101 such that bracket 201 does not otherwise contact housing 101 (e.g., bracket 201 may contact housing 101 only through fasteners 219 and/or spacers 217, etc.). In alternative embodiments, bracket 201 rests on and/or engages (e.g., slides upon, etc.) a surface of housing 101 (e.g., top portion 103 and/or side portion 105, etc.). In one embodiment, spacers 217 rotate and are wheels that support bracket 201 on housing 101 and allow for travel of bracket 201.

In one embodiment, bracket 201 includes a body portion. The body portion may include a top portion 203 and side portions 205. In one embodiment, top portion 203 and side portions 205 are formed from a single sheet of material (e.g., a metal sheet, etc.). Side portions 205 may be formed through bending. In alternative embodiments, bracket 201 is manufactured materials and/or techniques such as those described with reference to housing 101 (e.g., metals, plastics, molding, machining, etc.).

Bracket 201 further includes locking flange 207. As described in greater detail with reference to FIGS. 3A-3E, locking flange 207 is configured (e.g., shaped, etc.) to selectively engage a portion of existing strip fixture 301 and thereby selectively secure light fixture 100 to existing strip fixture 301. By way of example, locking flange 207 may selectively interface with a portion of existing strip fixture 301 when brackets 201 are engaged (e.g., in a locking position, etc.). In the embodiment shown in FIG. 3E, locking flange 207 includes first portion 209, second portion 211, third portion 213, and fourth portion 215. First portion 209 may extend downward and away from bracket 201. By way of example, first portion 209 may extend downward and away from an upper edge of bracket 201 (e.g., an edge in confronting relation to an end of housing 101, etc.). Such an arrangement may position locking flange 207 closer to the plane of a flange of existing strip fixture 301 to which locking flange 207 will engage when bracket 201 is moved into a locked position. Second portion 211 may extend at an upward angle from the end of first portion 209. An angularly offset second portion 211 (e.g., relative to first portion 209, etc.) may facilitate locking flange 207 engaging with portions of a housing 303 (e.g., a flange, etc.) of existing strip fixture 301 having one of various geometries. In some embodiments, locking flange 207 includes third portion 213 and fourth portion 215 that form a locking portion (e.g., a latch, a pawl, a catch, etc.). Third portion 213 may extend at a downward angle from second portion 211. Third portion 213 may form a notch (e.g., between second portion 211 and third portion 213, etc.) that engages with a lip or other structure of housing 303 of existing strip fixture 301. Third portion 213 may prevent locking flange 207 from slipping (e.g., backward away from a lip or other structure of housing 303, etc.) relative to housing 303 of existing strip fixture 301. Fourth portion 215 may extend at an upward angle from third portion 213. Fourth portion 215 may extend upward to facilitate locking flange 207 engaging with housing 303 of an existing strip fixture 301 (e.g., guide housing 303 of existing strip fixture 301 beneath locking flange 207, guide locking flange 207 over a lip of the housing 303, etc.). In some embodiments, fourth portion 215 is chamfered. A chamfered fourth portion 2015 may facilitate in guiding locking flange 207 and/or bracket 201 within a width of housing 303 of existing strip fixture 301.

Locking flange 207 may be formed using one or more the of the manufacturing techniques previously described herein. For example, locking flange 207 may be formed by bending a sheet of material. In some embodiments, locking flange 207 is joined to, or formed from the same sheet of material, as the remainder of bracket 201.

In alternative embodiments, locking flange 207 has another configuration. For example, locking flange 207 may be a single section extending at an angle from bracket 201. Locking flange 207 may have more or fewer portions than previously described. Locking flange 207 may further include additional features or components that engage with housing 303 of existing strip fixture 301. For example, locking flange 207 may include a high friction and/or adhesive surface configured to engage with housing 303 of existing strip fixture 301.

In some embodiments, light fixture 100 includes spacers 217. Spacers 217 may center bracket 201 within housing 101 (e.g., in between side portions 105 of housing 101, etc.). Spacers 217 may be in contact with side portions 105 of housing 101. In some embodiments, spacers 217 are coupled to bracket 201 by the same fasteners 219 that couple bracket 201 to housing 101. Advantageously, spacers 217 facilitate housing 101 having a width larger than that of bracket 201. Spacers 217 may thereby facilitate bracket 201 engaging with existing strip fixture 301 having a housing 303 with a first width (e.g., a wider width, etc.). Housing 101 of light fixture 100 may be wider than the existing strip fixture 301 with a housing 303 having the first width. This allows housing 101 of light fixture 100 to extend around existing strip fixture 301. Spacers 217 may position bracket 201 such that housing 101 will be centered over existing strip fixture 301 when brackets 201 are engaged (e.g., slid into a locked or extended position from a disengaged or withdrawn position, etc.). Spacers 217 may additionally or alternatively facilitate a width of housing 101 that is wide enough to fit around and/or cover, partially or completely, existing strip fixtures 301 with housings 303 having a width greater than the first width. As bracket 201 remains centered due to spacers 217 and locking flange 207 has a width compatible with narrower existing strip fixture 301, light fixture 100 may be used to retrofit narrow or wider existing strip fixtures 301.

Referring now to FIGS. 3A-3D generally, an existing strip fixture 301 is illustrated along with light fixture 100 in relationship to existing strip fixture 301 during various stages of retrofitting existing strip fixture 301, according to one embodiment. Components of existing strip fixture 301 may be removed and/or repositioned within housing 303 of existing strip fixture 301. This may provide space and/or access for components of light fixture 100 (e.g., driver 401, brackets 201, etc.). One or more components of light fixture 100 (e.g., a power supply, driver 401, and/or other components) may be wired to existing strip fixture 301 (e.g., a power source disconnected from existing strip fixture 301). Light fixture 100 is placed over existing strip fixture 301 with brackets 201 in an unlocked position (e.g., a withdrawn position, etc.). Housing 101 of light fixture 100 thereby fits around housing 303 of existing strip fixture 301 without interference from brackets 201. Once light fixture 100 is positioned around existing strip fixture 301, brackets 201 may be slid into a closed, extended, and/or locked position. In the closed, extended and/or locked position, locking flanges 207 engage with a portion of housing 303 of existing strip fixture 301 (e.g., flange 311). Locking flanges 207 prevent light fixture 100 from becoming uncoupled from housing 303 of existing strip fixture 301 (i.e., locking flanges 207 are configured to attach light fixture 100 to housing 303 of existing strip fixture 301, etc.).

Figure 3B:
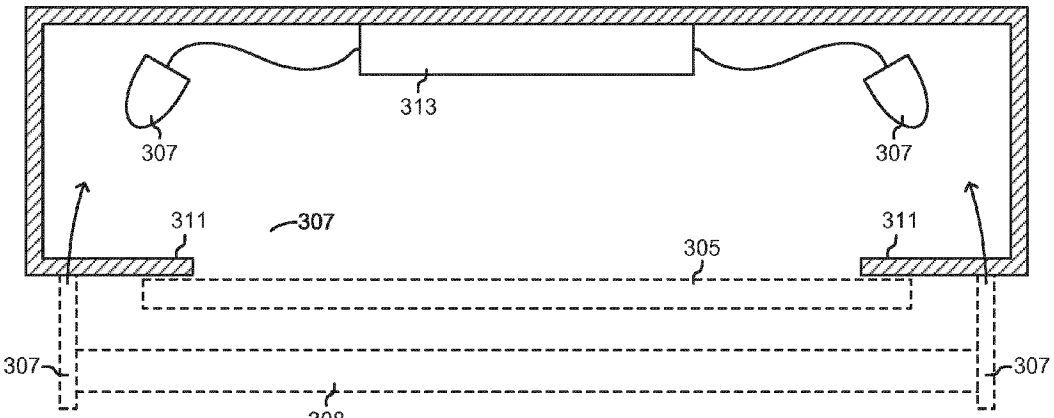
FIG. 3B is a sectional view of an existing strip-style light fixture showing internal components thereof, according to one embodiment.
Figure 3A:
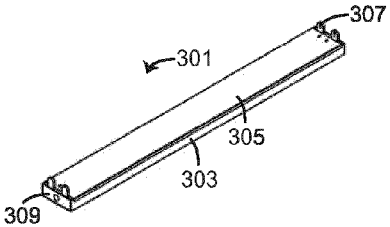
FIG. 3A is a perspective view of an existing strip fixture, according to one embodiment.

Referring now to FIG. 3A, an existing strip fixture 301 is illustrated, according to one embodiment. Existing strip fixture 301 includes housing 303. Housing 303 may contain electronic components of existing strip fixture 301 such as a ballast, a power supply, sensors, control circuitry, wiring to lamp holders 307, and/or other components. Lamp holders 307 may extend outward from housing 303. In one embodiment, lamp holders 307 extend through flange 311 of housing 303 such that lamp holders 307 may be pushed within housing 303 without the use of tools as described in greater detail with reference to FIG. 3B. Lamp holders 307 may be configured to hold and/or provide electrical power to one or more tube-type fluorescent lamps. For example, existing strip fixture 301 may include two adjacent fluorescent lamps. Housing 303, including end portion 309, may be wide enough to accommodate two adjacent lamps and their associated lamp holders 307. In alternative embodiments, existing strip fixture 301 may have more or fewer lamps and/or lamp holders 307 and/or may have a housing 303 with a greater or narrower width. In some embodiments, existing strip fixture 301 may further include access plate 305. Access plate 305 may be a removable section of housing 303 (e.g., removable with or without tools, etc.) that provides access to electronic components within housing 303. Access plate 305 may be used during the manufacturing process of existing strip fixture 301 to seal electronic components within housing 303. In alternative embodiments, housing 303 is open and does not include access plate 305.

In alternative embodiments, existing strip fixture 301 has another configuration. For example, existing strip fixture 301 may include a lens around fluorescent lamps contained within housing 303. The lens may be held in place by a flange of housing 303. In some embodiments, light fixture 100 is secured to existing strip fixture 301 at a flange of housing 303 for securing a lens. For example, the lens, lamps, ballast, lamp holders 307, and/or other components of existing strip fixture 301 may be removed and/or repositioned within housing 303. Brackets 201 of light fixture 100 may engage with the flange previously securing the lens of existing strip fixture 301 and/or another portion of housing 303 of existing strip fixture 301.

Prior to being retrofit with light fixture 100, existing strip fixture 301 may be installed in or on a structure. For example, existing strip fixture 301 may be installed in a ceiling system (e.g., an engineered ceiling system such as a drop ceiling or ceiling grid, etc.), hung from a ceiling, secured to a ceiling (e.g., a structural ceiling or other ceiling, etc.), hung from a wall, or otherwise installed in a structure.

To retrofit existing strip fixture 301, an installer may begin by removing the lamps and/or lens of existing strip fixture 301. The installer may further remove access plate 305 and/or push lamp holders 307 through housing 303.

Referring now to FIG. 3B, a cross section view looking towards the long edge (e.g., through the long side of housing 303, etc.) of existing strip fixture 301 is illustrated with lamp holders 307 pushed within housing 303 and with access plate 305 removed according to one embodiment. Lamps holders 307, as illustrated in dashed lines, extend downward from housing 303 through flange 311 before being moved within housing 303. Lamp holders 307 hold lamp 308. Lamp 308 (e.g., a fluorescent lamp), as illustrated in dashed lines, may be removed to provide access to access plate 305. Access plate 305, as illustrated in dashed lines, may be removed from existing strip fixture 301. Lamp holders 307 may be pushed through flange 311 of housing 303 of existing strip fixture 301 as illustrated by the arrows. This results in lamp holders 307 being located within housing 303, as illustrated in solid lines. Flange 311 may include openings through which lamp holders 307 were originally inserted during the manufacturing or instillation of existing strip fixture 301. Flanges 311 may further support or provide a portion to which access plate 305 is secured to housing 303 during the manufacturing and/or instillation of existing strip fixture 301.

With access plate 305 and/or other components of existing strip fixture 301 (e.g., a lens, etc.) removed, flanges 311 are exposed. In some embodiments, flanges 311 extend from an end portion 309 of housing 303. With lamp holders 307 pushed through or otherwise removed from housing 303 (e.g., flange 311, etc.), lamp holders 307 are contained within housing 303. Housing 303 may also contain ballast 313 and/or other electronic components. The removal of access plate 305 provides access to the interior of housing 303, in which one or more components of light fixture 100 may be inserted (e.g., brackets 201, driver 401, and/or other components).

To continue the retrofit process, an installer may position lamp holders 307 and/or ballast 313 within housing 303 of existing strip fixture 301. Positioning lamp holders 307 and/or ballast 313 may include removing these and/or associated components from housing 303. Alternatively, these and/or other components may be secured within housing 303 (e.g., using zip ties, adhesive, tape, and/or other components or techniques). In still further alternative embodiments, lamp holders 307 and/or ballast 313 are moved but kept loose within housing 303. These and/or other components of existing strip fixture 301 may be moved to provide space from components of light fixture 100 (e.g., brackets 201, driver 401, and/or other components) within housing 303 of existing strip fixture 301. Light fixture 100 may be wired to existing components of existing strip fixture 301. For example, a power source may be unwired from ballast 313 and wired to a power supply and/or driver 401 of light fixture 100. Further components, (e.g., sensors, control circuits, etc.) may also be wired to light fixture 100. With brackets 201 of light fixture 100 in the open or unlocked position, light fixture 100 may be placed over existing strip fixture 301.

Figure 3C:
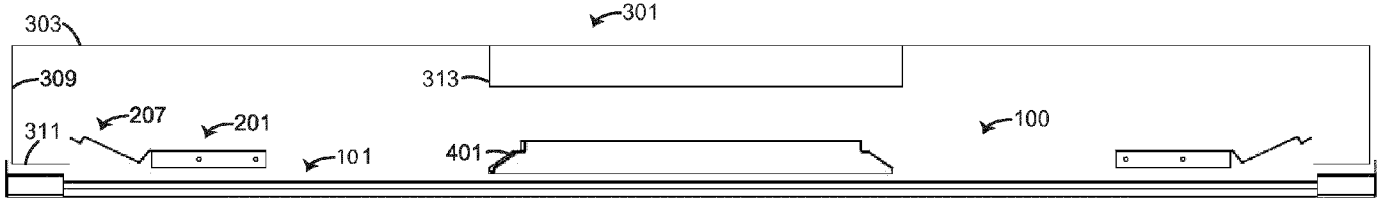
FIG. 3C illustrates the relationship between a light fixture for retrofitting an existing strip fixture and the existing strip fixture itself, according to one embodiment.

Referring now to FIG. 3C, a sectional view of light fixture 100 and existing strip fixture 301 is illustrated, according to one embodiment. Light fixture 100 is positioned over and within existing strip fixture 301 as part of the retrofit process. Brackets 201 are in the open or unlocked position such that locking flanges 207 may pass above flanges 311 of existing strip fixture 301. Housing 101 of light fixture 100 may partially surround, encompass, and/or cover housing 303 of existing strip fixture 301. Brackets 201, driver 401, and/or other components of light fixture 100 are located within housing 303 of existing strip fixture 301 due to the positioning of light fixture 100 around and within existing strip fixture 301. Lamp holders 307 (not pictured here) and/or ballast 313 may be positioned to provide clearance for the components of light fixture 100 positioned within housing 303 of existing strip fixture 301.

Figure 3D:
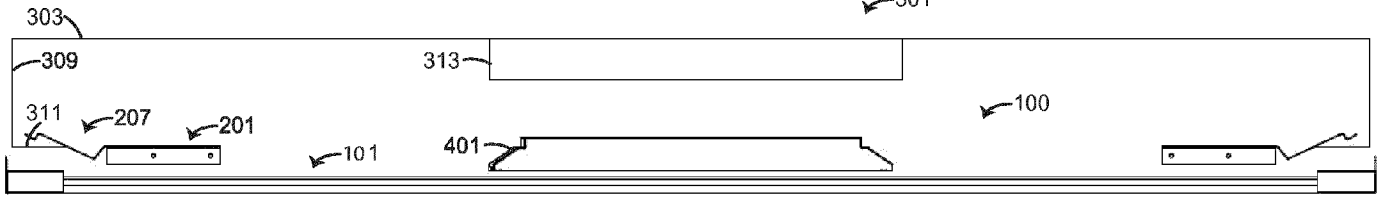
FIG. 3D illustrates a light fixture for retrofitting an existing strip fixture coupled to the strip fixture itself, according to one embodiment.

Referring now to FIG. 3D, a sectional view of light fixture 100 and existing strip fixture 301 is shown, according to one embodiment, with brackets 201 in the locked or closed position. To continue the retrofit process, brackets 201 are repositioned (e.g., slid using fasteners 219, etc.) into the closed or locked position. An installer may reposition brackets 201. Repositioning brackets 201 causes locking flanges 207 to engage with flange 311 of existing strip fixture 301. In some embodiments, flange 311 of existing strip fixture 301 may include a lip or other feature that third portion 213 and/or fourth portion 215 of locking flange 207 engage to prevent sliding bracket 201 from inadvertently disengaging from housing 303 of existing strip fixture 301. To continue the retrofit process, an installer may tighten (e.g., by hand, with a tool, etc.) fasteners 219 that secure brackets 201 in the closed or locked position. This further prevents locking flange 207 from inadvertently becoming disengaged from flange 311 of strip fixture 301.

Still referring to FIG. 3D, existing strip fixture 301 is illustrated, according to one embodiment in which strip fixture 301 is installed (e.g., on or from a ceiling). Locking flanges 207 interfere with, engage, and/or are in contact with flanges 311 to prevent light fixture 100 from falling from existing strip fixture 301. Locking flanges 207, and as a result brackets 201, housing 101 attached thereto, and the components attached to housing 101, are supported by flanges 311 of existing strip fixture 301. In various alternative embodiments in which strip fixture 301 is installed in different orientations, the relationship between brackets 201 and/or housing 101 of light fixture 100 and housing 303 of existing strip fixture 301 keep light fixture 100 secured in place and to existing strip fixture 301.

Figure 3E:
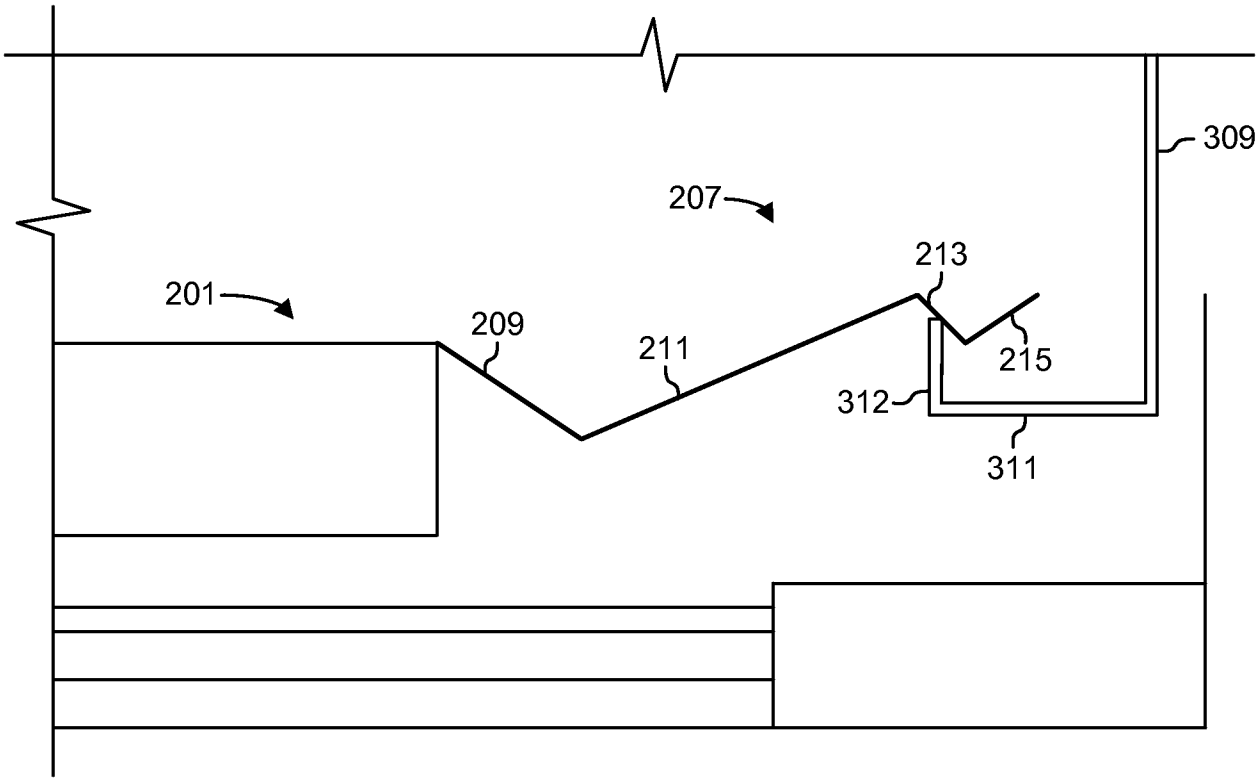
FIG. 3E is a sectional detailed view of a connection between a light fixture and an existing strip-style light fixture, according to an alternative embodiment.

Referring now to FIG. 3E, locking flange 207 of bracket 201 is shown in greater detail, particularly as it relates to housing 303 of existing strip fixture 301, according to one embodiment. In one embodiment, flange 311 of existing strip fixture 301 includes a vertical portion 312. Locking flange 207 of bracket 201 may engage with vertical portion 312. In some embodiments, fourth portion 215 of locking flange 207 contacts vertical portion 312 as bracket 201 is positioned into a closed or locked position. Fourth portion 215 causes locking flange 207 to deflect and travel above vertical portion 312. The angled configuration of fourth portion 215 may facilitate vertical movement of locking flange 207 as it contacts vertical portion 312 of existing strip fixture 301. As fourth portion 215 clears vertical portion 312 during the positioning of bracket 201 (e.g., is extended past vertical portion 312, etc.), locking flange 207 may move downward (e.g., spring back from the deflection caused by vertical portion 312). When bracket 201 is in the locked or closed position, a channel or notch formed by third portion 213 and second portion 211 of locking flange 207 may be engaged with vertical portion 312 of existing strip fixture 301. Advantageously, this may prevent bracket 201 from inadvertently becoming disengaged from flange 311 of existing strip fixture 301. Third portion 213 and second portion 211 are angled downward on both sides of vertical portion 312 of existing strip fixture 301. Therefore, the force needed to deflect locking flange 207 such that third portion 213 or second portion 211 may move over vertical portion 312 of existing strip fixture 301 keeps bracket 201 engaged with housing 303 of the existing strip fixture 301. The notch remains engaged with vertical portion 312 and bracket 201 is engaged with housing 303 of existing strip fixture 301 until sufficient force is applied. This may prevent inadvertent disengagement of bracket 201 from existing strip fixture 301.

In alternative embodiments, housing 303, including flange 311, may have another configuration. For example, flange 311 may not include vertical portion 312. Locking flange 207 and the configuration of the components thereof (e.g., first portion 209, second portion 211, third portion 213, and/or fourth portion 215, etc.) facilitate engagement of locking flange 207 with a variety of housings 303 of existing strip fixtures 301, the housings 303 having different characteristics. Such configuration of locking flange 207 provides an advantage in that light fixture 100 is compatible with and able to retrofit a variety of different existing strip fixtures 301.

Figure 4:
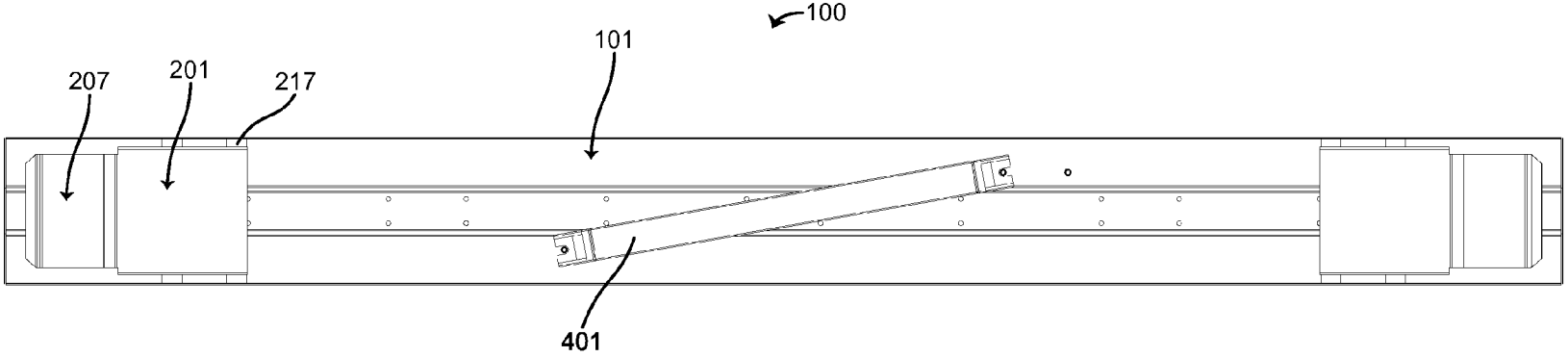
FIG. 4 is a top view of a light fixture for retrofitting an existing strip fixture, according to one embodiment.

Referring now to FIG. 4, a top view of light fixture 100 is illustrated, according to one embodiment. Light fixture 100 may include driver 401. Driver 401 is secured to housing 101 in some embodiments. Light fixture 100 may additionally or alternatively include other electronic components. For example, light fixture 100 may include a power supply, sensors (e.g., motion sensors, ambient light sensors, temperature sensors, and/or other sensors, etc.), transceivers for wireless communication, a control circuit for controlling the electronic components of light fixture 100, and/or other electronic components. One or more of these components may be positioned within housing 101 and/or attached to housing 101.

Brackets 201 are located within housing 101. Brackets 201 may be centered along the width of housing 101 (e.g., using spacers 217, etc.). In some embodiments (e.g., as illustrated), bracket 201 includes a locking flange 207 with a chamfered leading edge. As described with reference to FIG. 2, a chamfered flange 207 may facilitate moving brackets 201 from an open or unlocked position to a closed or locked position by guiding locking flange 207 within housing 303 of an existing strip fixture 301.

Figure 5:
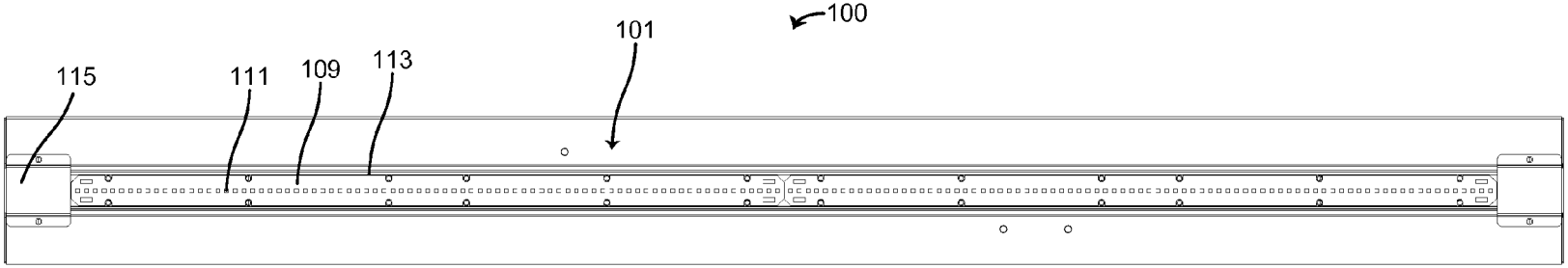
FIG. 5 is a bottom view of a light fixture for retrofitting an existing strip fixture, according to one embodiment.

Referring now to FIG. 5, a bottom view of light fixture 100 is illustrated, according to one embodiment. LED strips 109 including individual LEDs 111 are secured to housing 101. LED strips 109 may be located behind (e.g., covered by, etc.) lens 113. Lens 113 may be secured to housing 101 using lens retainer 115.

Figure 6:
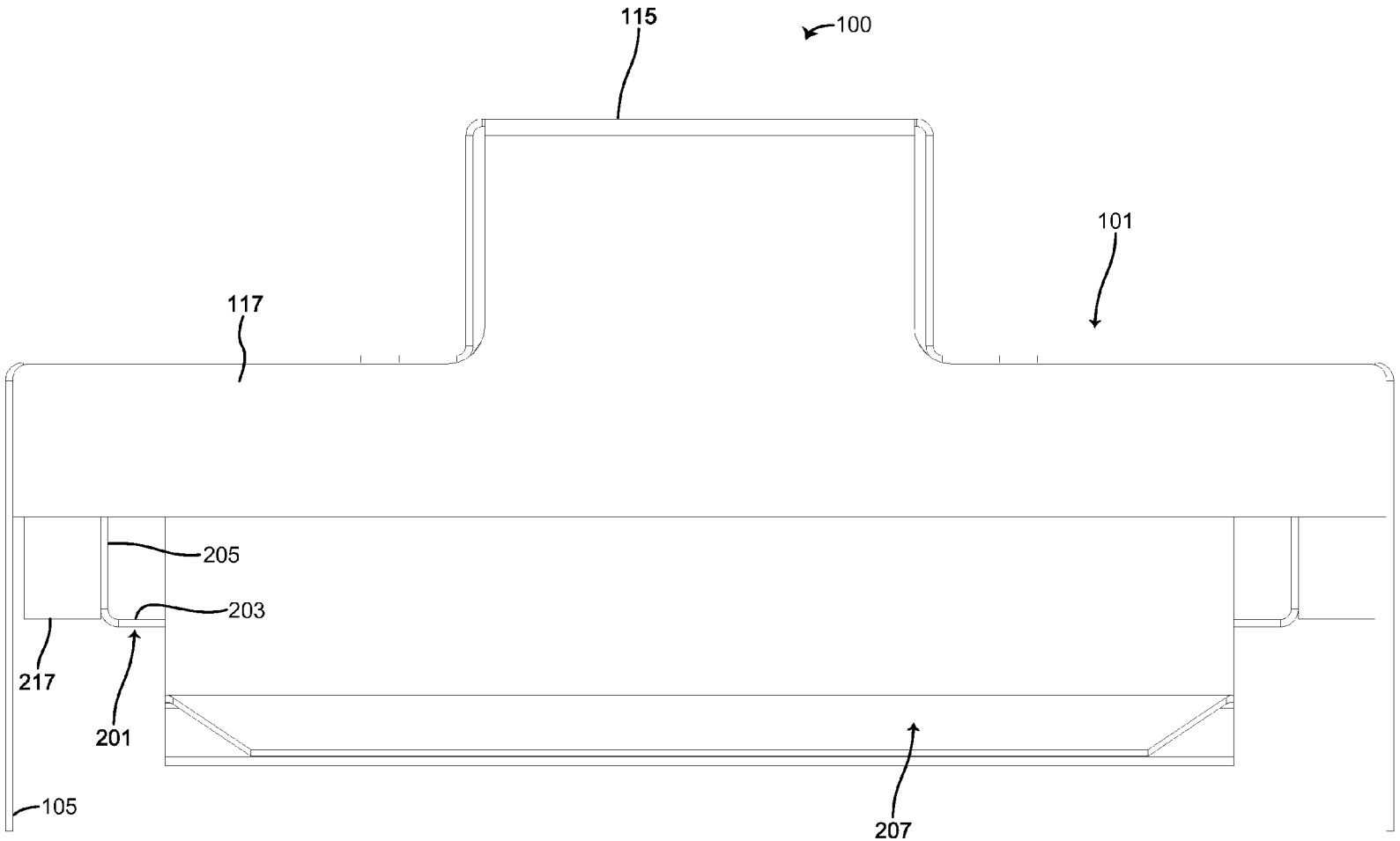
FIG. 6 is an end view of a light fixture for retrofitting an existing strip fixture, according to one embodiment.

Referring now to FIG. 6, an end view of light fixture 100 is illustrated, according to one embodiment. Lens retainer 115 and/or end cap 117 may be secured to housing 101 (e.g., using one or more fasteners, etc.). Bracket 201 including locking flange 207 is centered along the width of light fixture 100 (e.g., laterally centered, extend along a centerline thereof, etc.). Spacers 217 may be used to keep bracket 201 in a centered location. Spacers 217 may be secured to side portion 205 of bracket 201 (e.g., using fasteners 219, etc.). Spacers 217 may come into contact with side portion 105 of housing 101 should bracket 201 become offset (e.g., uncentered, etc.). Contact between spacers 217 and housing 101 may cause bracket 201 to remain centered or substantially centered. In alternative embodiments, spacers 217 remain in contact with both side portion 105 and side portion 205 to cause bracket 201 to remain centered. Spacers 217 may be or include a wear material configured to engage side portion 105 and/or top portion 103 of housing 101.

Spacers 217 and/or bracket 201 may be configured to create space between side portion 105 of housing 101 and locking flange 207 of bracket 201. Spacing side portion 105 and locking flange 207 facilitates partially surrounding and/or covering housings 303 of existing strip fixtures 301 having various widths with housing 101. Advantageously, the spacing facilitates compatibility between light fixture 100 and a variety of existing strip fixtures 301. Additionally, the narrower width of locking flange 207 and/or its centered location allow locking flange 207 to engage with housings 303 of existing strip fixtures 301 having a variety of widths.

Figure 7:
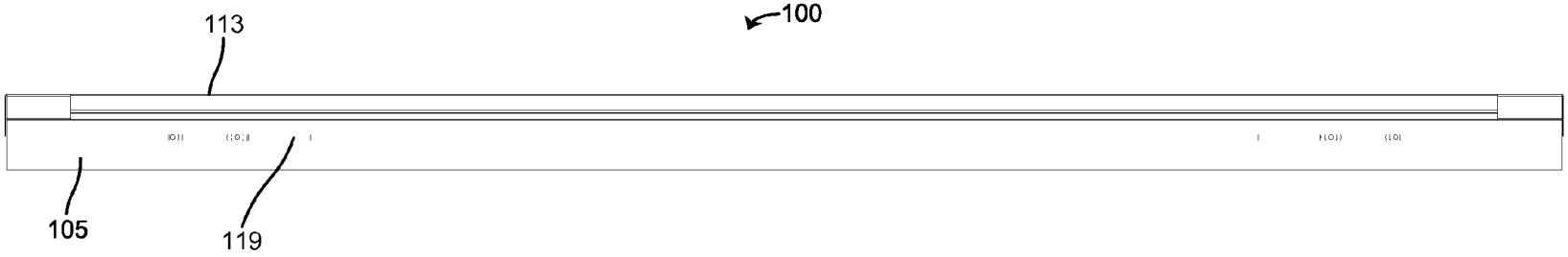
FIG. 7 is a side view of a light fixture for retrofitting an existing strip fixture, according to one embodiment.

Referring now to FIG. 7, a side view of light fixture 100 is illustrated, according to one embodiment. As discussed with reference to FIG. 1, housing 101 includes side portion 105. Side portion 105 may include slot 119 for securing bracket 201 (e.g., with fasteners 219, etc.) and/or providing access to move brackets 201. In some embodiments, lens 113 is visible from the side of light fixture 100. Advantageously, this may allow light fixture 100 to have a large field of light output. For example, light output from light fixture 100 may exit lens 113 across 180 degrees. In other embodiments, lens 113 may be shaped to create a field of light output having a larger or smaller angle. For example, lens 113 may curve in on itself to create a larger field of light output (e.g., 270 degrees). Alternatively, lens 113 is opaque or has a geometry that creates a field of light output narrower than 180 degrees (e.g., 90 degrees). A narrower field of light output may be used for applications such as task lighting.

Figure 8:
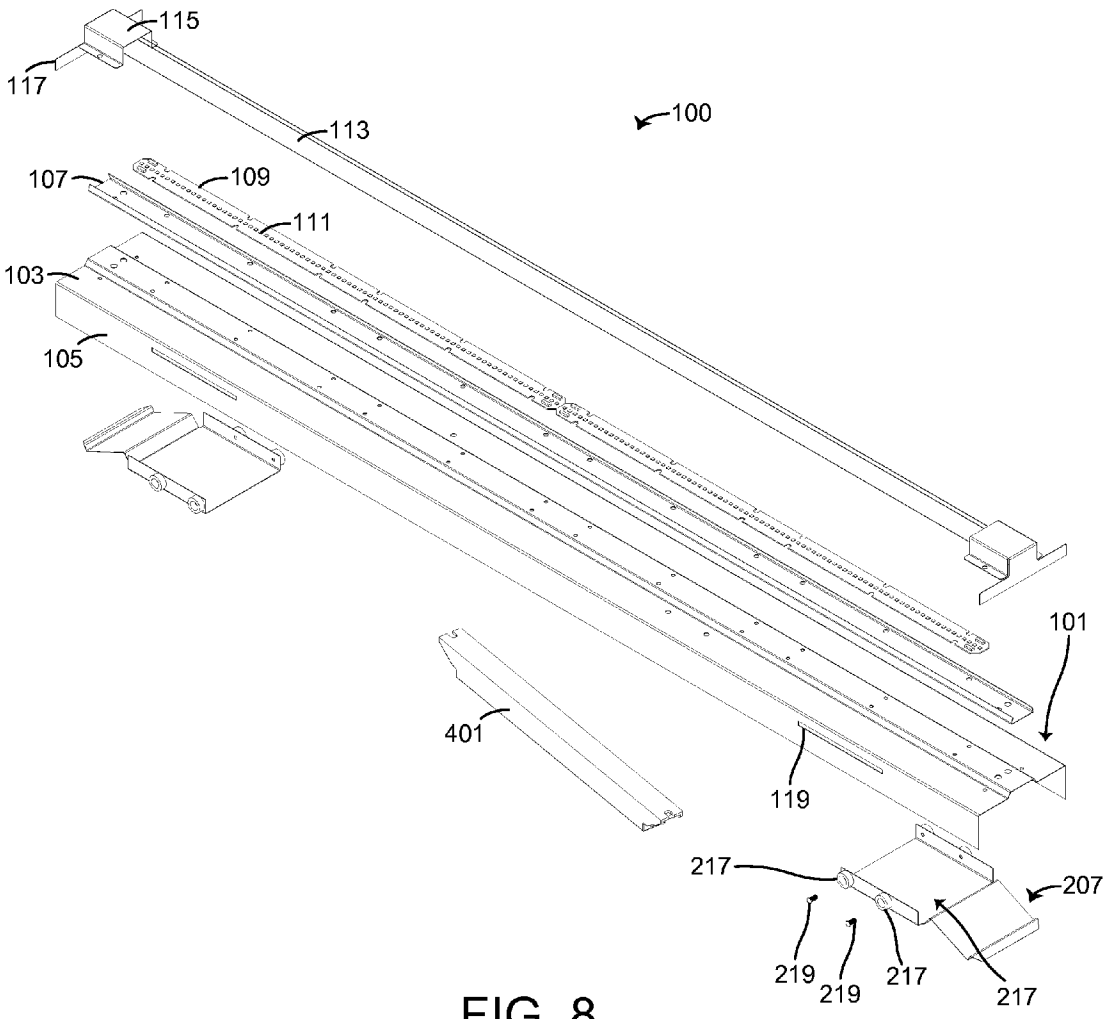
FIG. 8 is an exploded view of a light fixture for retrofitting an existing strip fixture, according to one embodiment.
Figure 9:
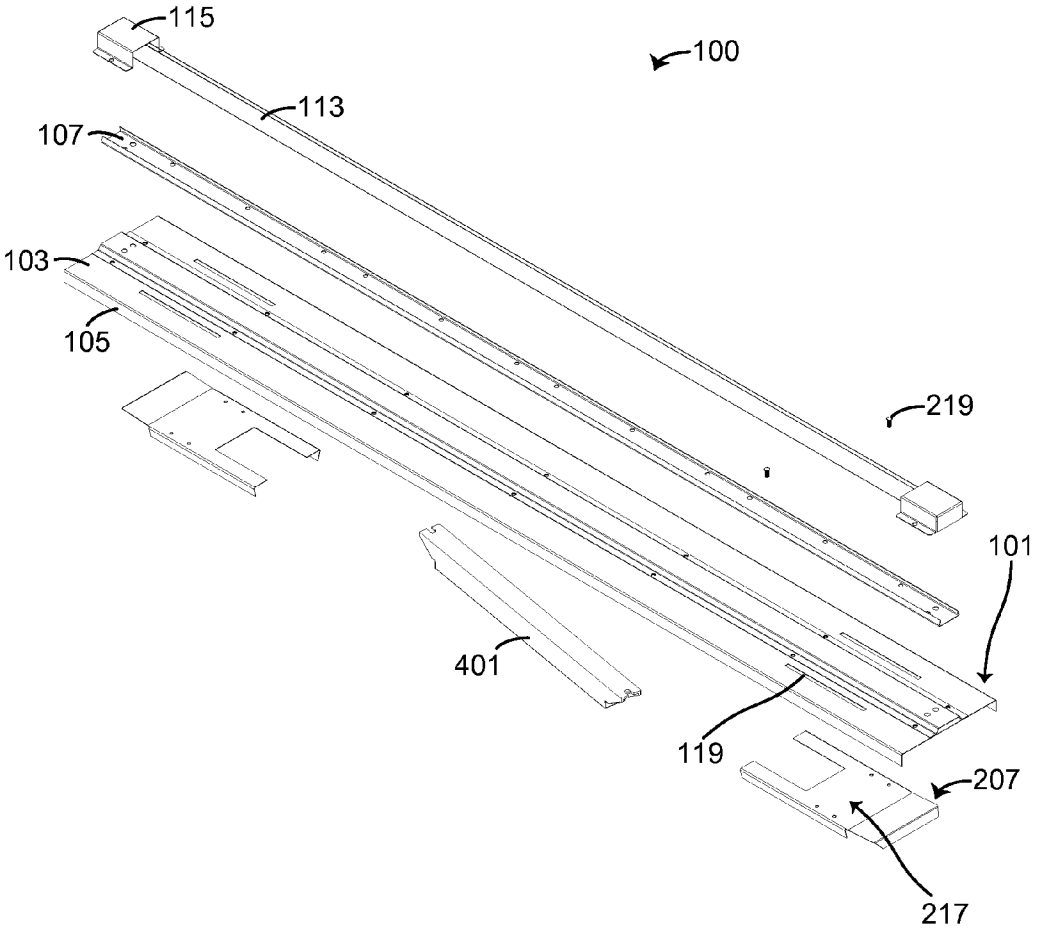
FIG. 9 is an exploded view of a light fixture for retrofitting an existing strip fixture having bottom-actuated sliding brackets, according to one embodiment.
Figure 10:
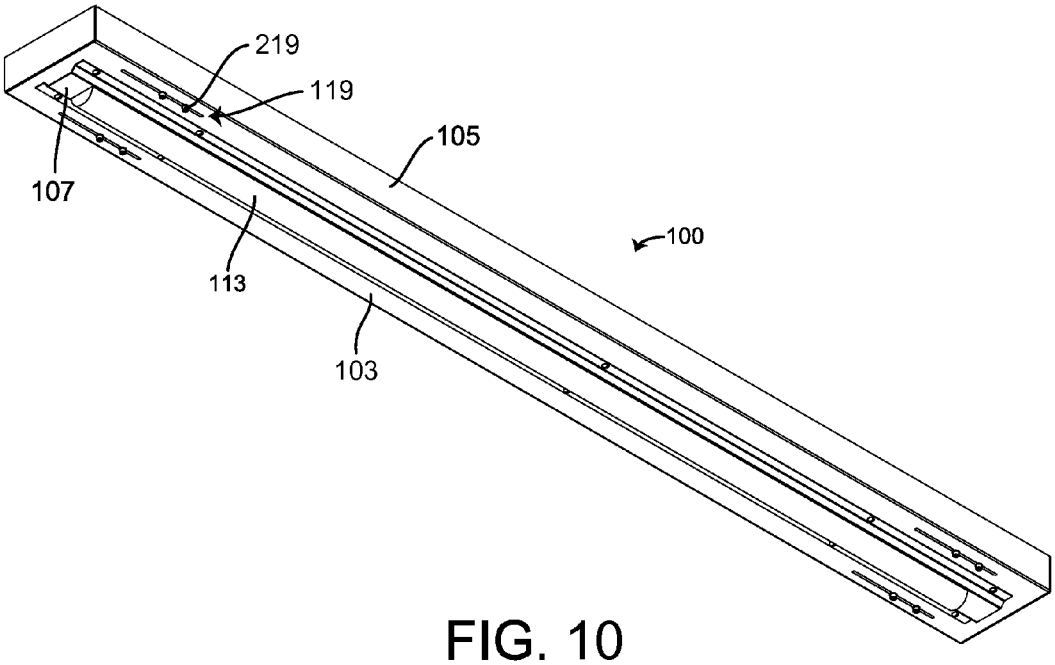
FIG. 10 is a perspective view of a light fixture for retrofitting an existing strip fixture having bottom-actuated sliding brackets, according to one embodiment.
Figure 11:
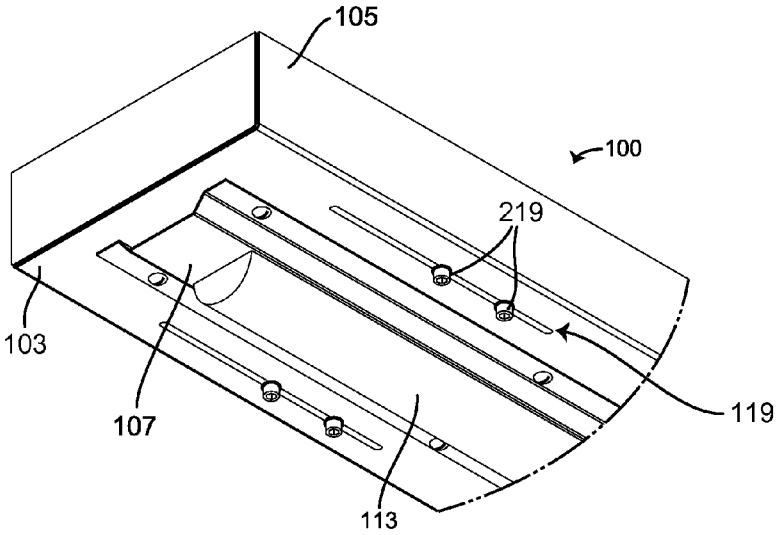
FIG. 11 is an end view of a light fixture for retrofitting an existing strip fixture having bottom-actuated sliding brackets, according to one embodiment.
Figure 12:
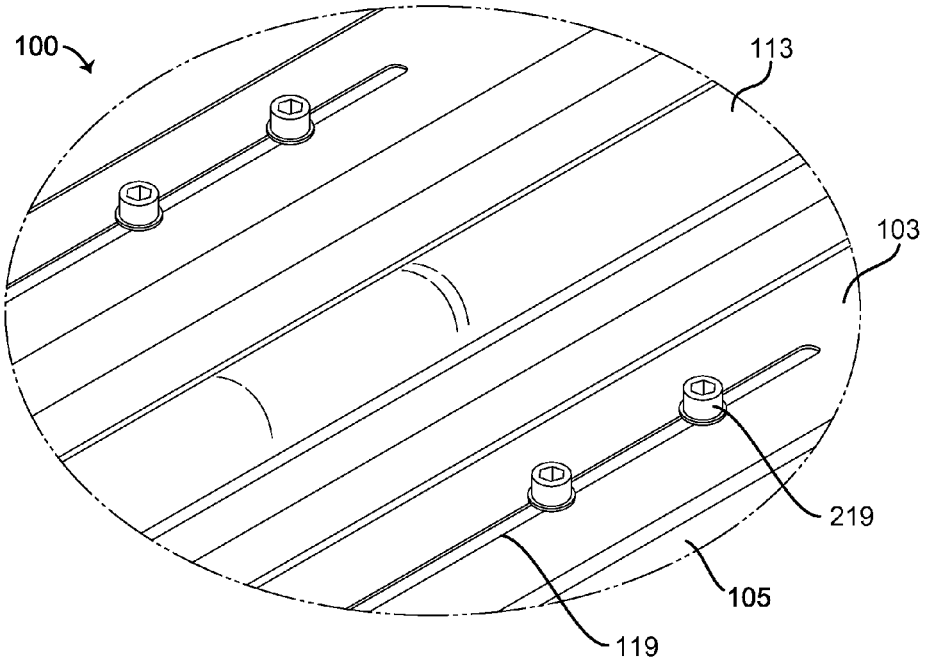
FIG. 12 is a detail view of a light fixture for retrofitting an existing strip fixture having bottom-actuated sliding brackets, according to one embodiment.
Figure 13:
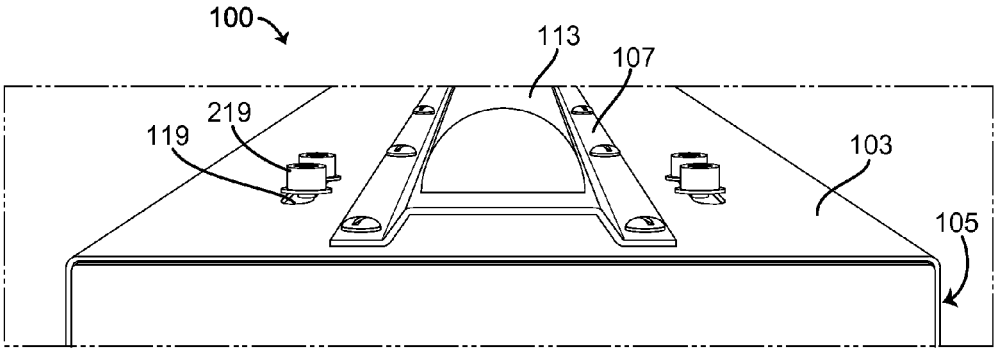
FIG. 13 is an end detail view of a light fixture for retrofitting an existing strip fixture having bottom-actuated sliding brackets, according to one embodiment.

Referring now to FIG. 8, an exploded view of light fixture 100 is illustrated according to one embodiment. Various components of light fixture 100 may be assembled using a variety of techniques. In some embodiments, fasteners may be used to couple components of light fixture 100 to one another. For example, LED strips 109 may be coupled to mounting plate 107 using screws or other fasteners. In some embodiments, components are secured by an interference fit and/or by retaining components. For example, lens 113 may be secured to housing 101 by lens retainers 115 and/or mounting plate 107. In still further embodiments, other components and/or techniques are used to assembly light fixture 100. For example, adhesive may be used.

In alternative embodiments, light fixture 100 includes more or fewer components. For example, light fixture 100 may not include mounting plate 107. The features of mounting plate 107 may be included in housing 101 without a separate component. In further alternative embodiments, one or more components of light fixture 100 may have various alternative geometries or shapes. For example, lens 113 may extend along the entire or substantially the entire width of light fixture 100. Housing 101 may have a shape other than a generally rectangular shape. For example, housing 101 may be rounded, have radius edges, have chamfered edges, and/or have other shapes.

Referring now to FIGS. 9-13, light fixture 100 is illustrated according, to an alternative embodiment. In the embodiment shown in FIGS. 9-13, slots 119 of light fixture 100 are located on top portion 103 of housing 101 rather than on side portion 105. Brackets 201 may be secured to housing 101 using fasteners 219 which partially pass through slots 119 defined by top portion 103. Such an arrangement facilitates the actuation of brackets 201 from below light fixture 100 during the retrofitting of an existing strip fixture 301. Engagement of fasteners 219, bracket 201, and/or spacers 217 with the peripheries of slots 119 may laterally center bracket 201 within housing 101. The components of light fixture 100 may function the same or similarly to those previously described herein with respect to embodiments where slots 119 are located on side portions 105. In still other embodiments, both top portion 103 and side portions 105 of housing 101 define slots 119, and one or more fasteners extend therethrough to engage bracket 201.

Figure 14:
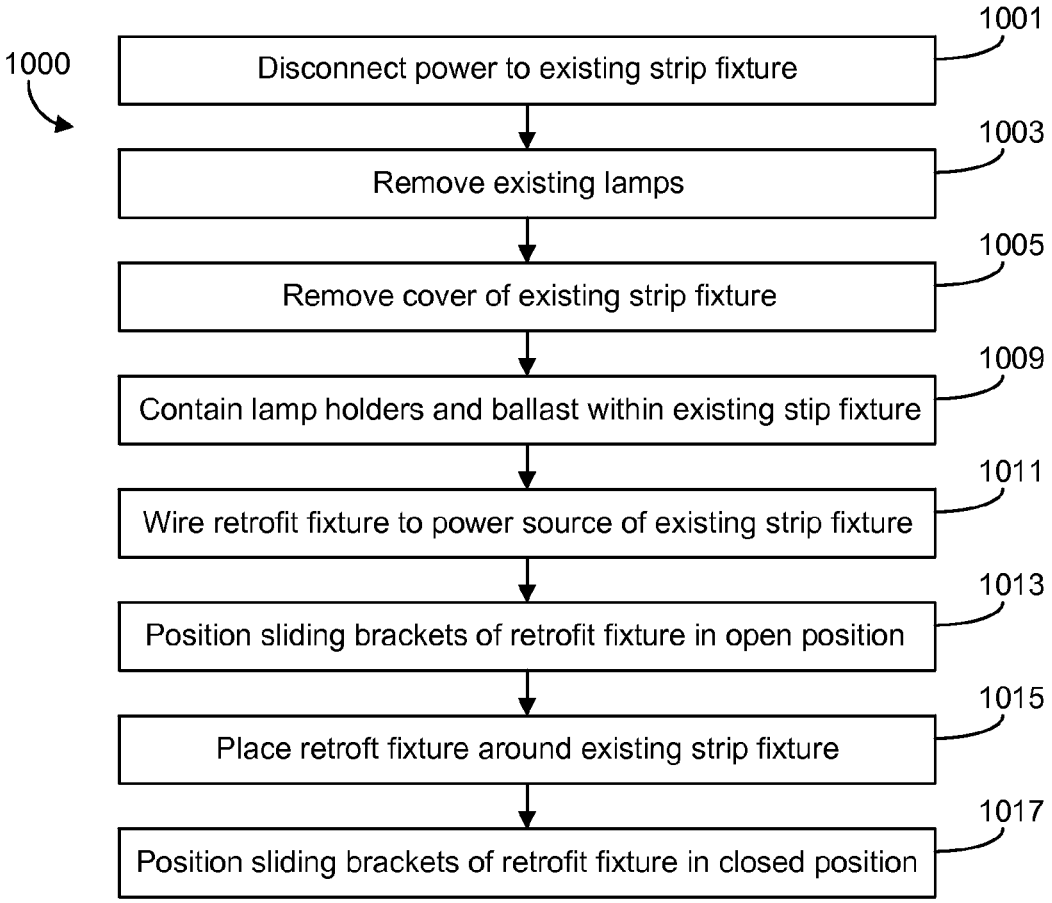
FIG. 14 illustrates a block diagram of a method for retrofitting an existing strip fixture with a light fixture according to one embodiment.

Referring now to FIG. 14, a method 1000 of retrofitting an existing strip fixture 301 with light fixture 100 is illustrated, according to one embodiment. An installer may disconnect power to an existing strip fixture 301 (1001). Disconnecting the power may include actuating a switch and/or breaker. Disconnecting the power may further include physically removing or disconnecting a wire from a power supply to the existing strip fixture 301. The installer may remove existing lamps from the existing strip fixture 301 (1003). Removing the lamps may include removing components to access the lamps such as one or more lenses, diffusers, and/or other components of existing strip fixture 301. The installer may further remove an access plate 305 of the existing strip fixture 301 (1005). Removing an access plate 305 may provide access to components located wholly or partially (e.g., lamp holders 307) within housing 303 of existing strip fixture 301. The installer may contain lamp holders 307, ballast 313, and/or other components of existing strip fixture 301 within housing 303 of the existing strip fixture 301 (1009). In some embodiments, containing components within housing 303 may include pushing lamp holders 307 through a flange 311 of housing 303 and into housing 303. Containing components may also include positioning the components to provide space for one or more portions of light fixture 100 (e.g., securing components using zip ties, fasteners, and/or other components or techniques). The installer may wire one or more components of light fixture 100 to one or more components of or associated with existing strip fixture 301 (1011). For example, the installer may wire driver 401 of light fixture 100 to a power source disconnected from existing strip fixture 301.

The installer may position brackets 201 of light fixture 100 in an open or unlocked position (1013). The installer (e.g., user, etc.) may position brackets 201 using fasteners 219 extending from housing 101 and/or handles attached to bracket 201. Positioning brackets 201 in the open or unlocked position may facilitate placing light fixture 100 in and around existing strip fixture 301 without interference between locking flanges 207 and housing 303 of the existing strip fixture 301. The installer may place light fixture 100 (e.g., as a retrofit fixture, etc.) around and within the existing strip fixture 301 (1015). Housing 101 may partially surround and/or cover housing 303 of existing strip fixture 301. Components of light fixture 100 such as brackets 201, driver 401, and/or other components may be located partially or completely within housing 303 of existing strip fixture 301. The installer may position brackets 201 in a closed or locked position (1017). Positioning brackets 201 in a closed or locked position may engage brackets 201 with existing strip fixture 301 such that light fixture 100 is secured to existing strip fixture 301. For example, locking flanges 207 of brackets 201 may engage with flanges 311 of housing 303 of existing strip fixture 301. The installer may tighten one or more fasteners 219 such that brackets 201 do not inadvertently disengage from housing 303 of existing strip fixture 301. The fasteners 219 may function as set screws. Fasteners 219 may travel further into bracket 201 and thereby apply pressure to housing 101 around slot 119, creating a friction force that opposes lateral movement of bracket 201.

Referring again to the FIGURES generally, light fixture 100 may be used to retrofit an existing strip fixture 301. Advantageously, this may allow for an existing strip fixture 301 to be retrofit to include a more efficient light source such as LEDs 111. Furthermore, light fixture 100 may include electronic components such as motion sensors, control circuits, transceivers, and/or other components which may not be included in an existing strip fixture 301. Retrofitting the existing strip fixture 301 with light fixture 100 may result in greater control over the resulting fixture using electronic components included in the light fixture 100.

In some alternative embodiments, light fixture 100 may be provided with an additional housing section that attaches to housing 101 via brackets 201 and/or other features of light fixture 100. The additional housing may seal or substantially seal light fixture 100. The additional housing may further include mounting hardware for mounting light fixture 100 to a ceiling, wall, and/or other portion of a structure. The additional housing may facilitate using light fixture 100 in new construction applications and/or otherwise using light fixture 100 as a standalone fixture. In some embodiments, housing 101 detaches from the additional housing. A detachable housing 101 may facilitate using light fixture 100 as a complete fixture (e.g., in new construction applications, etc.) and/or using light fixture 100 in retrofitting and existing strip fixture 301. Advantageously, the detachable housing 101 may increase the number of applications or which light fixture 100 may be used.

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure

What is claimed is:

1. A retrofit light fixture for retrofitting an existing strip-style light fixture, the retrofit light fixture comprising:

a housing including a top portion, a side portion, and an end cap, the housing defining an interior space, wherein at least one of the top portion and the side portion define an elongated opening;

a light emitting diode coupled to the top portion of the housing;

a driver disposed within the interior space of the housing and configured to interface with the light emitting diode; and a bracket including a body and a locking flange, the locking flange configured to selectively engage with a portion of a housing of the existing strip-style light fixture, wherein the bracket is slidably coupled to the housing with a fastener that extends through the elongated opening, wherein the bracket is selectively repositionable between a disengaged orientation and an engaged orientation, the bracket configured to interface with a portion of the existing strip-style light fixture and thereby secure the retrofit light fixture in place when selectively repositioned into the engaged orientation;

wherein the bracket includes a first portion, a second portion coupled to the first portion, a third portion coupled to the second portion, and a fourth portion coupled to the third portion; and wherein the first portion extends downward and away from the body, wherein the second portion extends upward and away from the first portion, wherein the third portion extends downward and away from the second portion, and wherein the fourth portion extends upward and away from the third portion.

2. The retrofit light fixture of claim 1, wherein the first portion is angularly offset from a sidewall of the bracket and extends from an edge thereof, wherein the second portion is angularly offset from the first portion and extends from an edge thereof, wherein the third portion is angularly offset from the second portion and extends from an edge thereof, and wherein the fourth portion is angularly offset from the third portion and extends from an edge thereof.

3. The retrofit light fixture of claim 2, wherein the fourth portion is chamfered.

4. The retrofit light fixture of claim 1, wherein the fastener comprises at least one of a peg and a set screw positioned to selectively force the bracket into engagement with the housing and thereby hold the bracket in place when tightened.

5. The retrofit light fixture of claim 1, wherein the bracket is actuatable from the exterior of the housing by applying force to the fastener without the use of a tool, and wherein the bracket is selectively repositionable without removing a fastener.

6. The retrofit light fixture of claim 1, further comprising a lens secured to the housing, wherein the lens extends along the length of the retrofit light fixture.

7. The retrofit light fixture of claim 1, further comprising an individual lens for the light emitting diode.

8. The retrofit light fixture of claim 1, further comprising a light emitting diode strip, wherein the light emitting diode is disposed on the light emitting diode strip.

9. A retrofit light fixture for retrofitting an existing strip-style light fixture, the retrofit light fixture comprising:

a housing;

a light source coupled to the housing; and a bracket slidably coupled to the housing and configured to selectively engage with a portion of the existing strip-style light fixture;

wherein the bracket includes a body, a first portion, a second portion, a third portion, and a fourth portion, wherein the first portion is angled downward from the body, wherein the second portion is angled upward from the first portion, wherein the third portion is angled downward from the second portion, and wherein the fourth portion is angled upward from the third portion.

10. The retrofit light fixture of claim 9, wherein a top portion of the housing defines a slot, wherein the bracket is slidably coupled to the housing with a fastener that extends through the slot, and wherein the bracket is selectively repositionable from below the retrofit light fixture.

11. The retrofit light fixture of claim 9, wherein a side portion of the housing defines a slot, wherein the bracket is slidably coupled to the housing with a fastener that extends through the slot, and wherein the bracket is selectively repositionable from alongside the retrofit light fixture.

12. The retrofit light fixture of claim 9, wherein the light source comprises at least one of a plurality of light emitting diodes, an incandescent lamp, and a fluorescent lamp.

13. A method for retrofitting an existing strip-style light fixture with a retrofit light fixture, the method comprising:

repositioning at least one component of the existing strip-style light fixture;

placing the retrofit light fixture around the existing strip-style light fixture, wherein a housing of the retrofit light fixture at least partially surrounds a housing of the existing strip-style light fixture; and actuating a sliding bracket of the retrofit light fixture into a locked position, wherein the sliding bracket includes a body, a first portion, a second portion coupled to the first portion, a third portion coupled to the second portion, and a fourth portion coupled to the third portion, wherein the first portion extends downward and away from the body, wherein the second portion extends upward and away from the first portion, wherein the third portion extends downward and away from the second portion, and wherein the fourth portion extends upward and away from the third portion, and wherein at least one of the first portion, the second portion, the third portion, and the fourth portion of the sliding bracket engages with a portion of the housing of the existing strip-style light fixture to secure the retrofit light fixture to the existing strip-style light fixture.

14. The method of claim 13, wherein repositioning at least one component of the existing strip-style light fixture includes removing one or more components of the existing strip-style light fixture.

15. The method of claim 14, further comprising disconnecting a power source from the existing strip-style light fixture and wiring the retrofit light fixture to the power source.

* * * * *